United States Patent [19]

Anderson

[11] Patent Number: 4,872,499

[45] Date of Patent: Oct. 10, 1989

[54] VERTICAL LOUVRE BLIND TRAVELLER BRIDLE

[75] Inventor: Richard N. Anderson, Owensboro, Ky.

[73] Assignee: Hunter Douglas Inc., Upper Saddle River, N.J.

[21] Appl. No.: 154,728

[22] Filed: Feb. 11, 1988

Related U.S. Application Data

[63] Continuation-in-part of Ser. No. 853,818, Apr. 18, 1986, Pat. No. 4,732,202.

[51] Int. Cl.[4] ..... E06B 9/36

[52] U.S. Cl. ..... 160/168.1; 160/173; 160/900

[58] Field of Search ..... 160/173, 168.1, 178.1, 160/176.1, 177, 900, 172, 126

[56] References Cited

U.S. PATENT DOCUMENTS

| | | | |
|---|---|---|---|
| 3,343,588 | 9/1967 | Cayton | 160/900 X |
| 3,743,002 | 7/1973 | Ford | 160/126 |
| 3,978,904 | 9/1976 | Riebock et al. | 160/126 X |
| 4,114,673 | 9/1978 | de Wit et al. | 160/173 X |
| 4,115,898 | 9/1978 | Frentzel | 160/900 X |
| 4,425,956 | 1/1984 | Terlecke | 160/168.1 |
| 4,552,195 | 11/1985 | Durig et al. | 160/168.1 |
| 4,732,202 | 3/1988 | Anderson | 160/178.1 X |

FOREIGN PATENT DOCUMENTS 740252 8/1966 Canada .

*Primary Examiner*—Blair M. Johnson
*Assistant Examiner*—David M. Purol
*Attorney, Agent, or Firm*—Pennie & Edmonds

[57] ABSTRACT

A bridle for a lead traveller is disclosed. Post structure extends downwardly from the bottom of the spacer. In one embodiment, a loop is formed in the blind pull cord and passed downward through an opening in the bridle and over said post. The bridle is thereby frictionally fixed on said pull cord. In another embodiment the post structure frictionally engages the pull cord which is permitted to slip with respect thereto upon a predetermined loading.

11 Claims, 7 Drawing Sheets

VERTICAL LOUVRE BLIND TRAVELLER BRIDLE

RELATED APPLICATION

This application is a continuation-in-part of U.S. patent application Ser. No. 853,818, filed Apr. 18, 1986, now U.S. Pat. No. 4,732,202 for VERTICAL LOUVRE BLIND TRAVELLER to Richard N. Anderson.

BACKGROUND

1. Field of the Invention

The invention relates to window treatments and in particular to vertical Louvre Blinds each and travellers therefor.

2. Related Art

Vertical louvre blinds usually comprise a headrail with several travellers movable along the headrail by one means or another. Each of the travellers has a rotatable hook which holds a vane carrier. The vane carriers in turn hold the vanes or louvres of the blind. The travellers are capable of moving longitudinally along the headrail and imparting rotary movement to the hooks to rotate or tilt the louvres. The rotation is such that all of the louvres are operated simultaneously so that they always extend in planes substantially parallel to one another. Provision is often made to allow the blinds to move slightly if they are inadvertently hit.

The travellers are pulled through the headrail by a cord attached to a bridle on which the lead traveller is mounted. As the bridle and lead traveller are pulled along the headrail slack is taken up in a spacer means between the lead and second traveller. The spacer means pulls adjacent travellers along at predetermined separations. This provides even spacing between the travellers when extended. When the cord is pulled in the opposite direction the lead traveller moves back towards its adjacent traveller providing slack in the separation means. The lead traveller collides with the second traveller and pushes it along. These travellers continue along to stack each adjacent traveller and pushing all the travellers back to the retracted position.

With center draw types of headrail where two blinds are mounted for movement towards and away from each other, it is necessary to provide two bridles for two lead travellers. With such a construction, the pull cords for the blind have their ends attached to one of the bridles and are attached to the other bridle intermediate the ends of the cord. With prior constructions this connection intermediate the ends of the pull cord has typically involved the use of a traveller support which is made of stamped metal with stamped protrusions for connecting to the cord, as for example, described in U.S. Pat. No. 3,427,679 and Canadian Patent No. 740,252. Such stamped supports present sharp edges which can wear on the cord. Also the stamped metal protrusions can loosen during long time use of the blind. The prior art also includes blind constructions wherein master carriers for the blind are manufactured from thermoplastic material with the cord end held therein by a tight non-slipping frictional fit. See, for example, U.S. Pat. No. 4,438,798.

Further, some blind arrangements result in unequal amounts of blind material on either side of the meeting point of the two blinds as they are drawn together. The prior art constructions are provided with mechanisms to permit continued movement of the larger section after the smaller section of blind has been fully extended or fully retracted. This is necessary in order to fully open or fully close the larger section of blind. In this regard reference is made to U.S. Pat. Nos. 4,293,021, 4,552,195 and 4,648,436 which disclose various forms of cord connections permitting slippage when the blind reaches a fully extended or retracted position.

SUMMARY OF THE PRESENT INVENTION

The present invention includes a novel form of bridle which permits a headrail to be modified as a center draw headrail. In a center draw headrail, the travellers move from either side of the headrail to the center when they are extended. Because only one lead traveller can be tied to the ends of the closing cord, it is necessary to provide attachment for the bridle of the second lead traveller to an intermediate section cord. In the bridle of the present invention a bight or loop is formed in the closing cord. This loop is inserted through an opening in the bridle from above the bridle to below the bridle. The loop is then hooked over a post on the bottom of the bridle. Two sharp corners are provided on either side of the post such that tension on the cord in either direction engages the cord with one of the corners to prevent slipping.

In a modified form of the bridle, provision is made for permitting slippage of the pull cord through the connection posts on the bridle. This slippage occurs only when the loading of the pull cord, in a direction of its length, is above a predetermined level. At all other times the pull cord remains fixed to the bridle. With the permitted slippage, the shorter section of blind can extend to its fully opened or fully closed position. Further movement will then be blocked and the load, i.e., the tension, on the cord will therefore increase. The post connection of the present invention will allow the cord to slip through the connection while the wider section of blind continues its movement to its fully opened or closed position.

The bridle of the present invention is further constructed so as to uniquely receive the end travellers with which it is associated in a compact and precision manner. With this connection, smooth sliding of the bridle and lead travellers in the headrail is assured.

BRIEF DESCRIPTION OF THE DRAWINGS

A detailed description of the invention will now be given with reference to the drawings wherein.

DETAILED DESCRIPTION OF THE PREFERRED EMBODIMENTS

Figure 1:
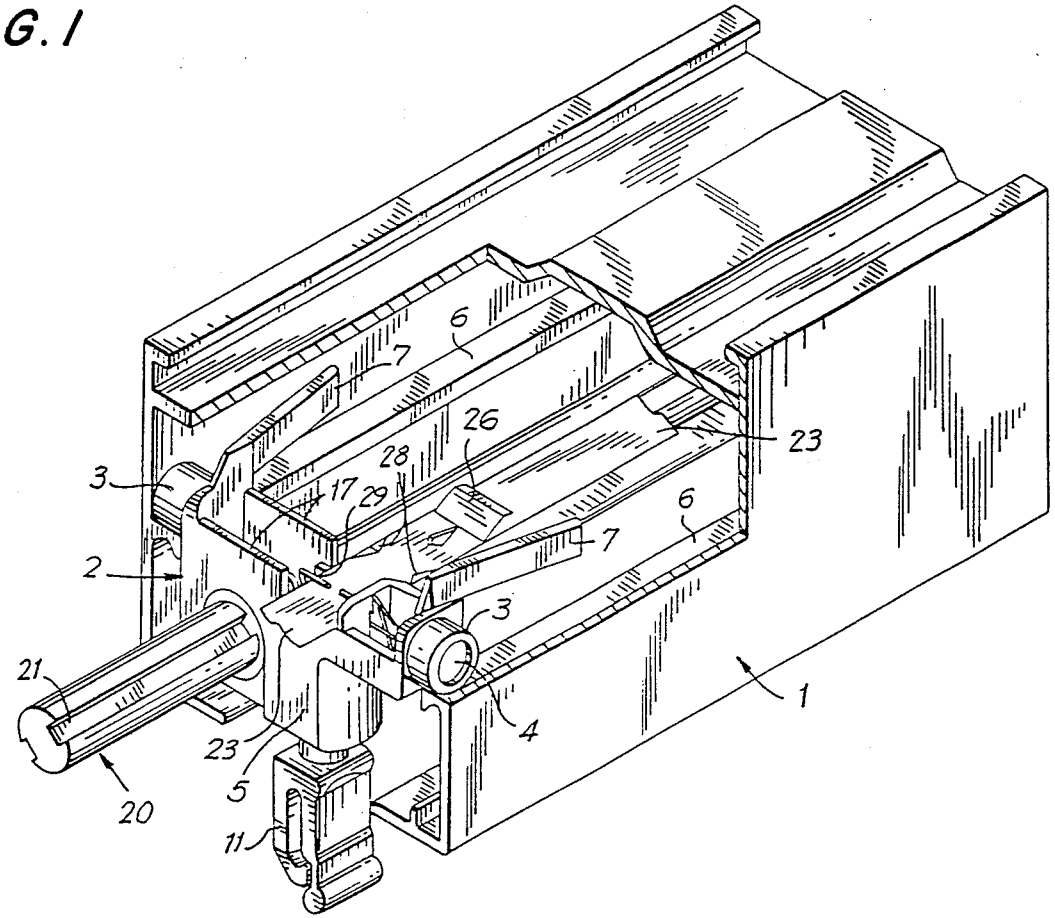
FIG. 1 is a partially cutaway perspective view of the headrail of the invention showing a traveller of the invention.

Referring to FIG. 1 there is shown a headrail 1 having at least one traveller 2 disposed therein. The traveller 2 shown is an intermediate traveller. The lead traveller will be described below in connection with FIGS. 7 and 8. The traveller has a pair of wheels 3 which are mounted on shafts 4 on either side of the traveller housing 5. The wheels ride on ledges 6 formed within the headrail. The wheels 3 provide low friction movement of the traveller 2 within headrail 1. The traveller housing 5 is provided with a pair of cantilevered wings 7 which extend forwardly from the traveller 2, at a slightly diverging angle. The wings 7 engage the walls of the headrail to maintain the proper orientation of the traveller with the headrail so the traveller remains with wheel 3 resting on ledges 6.

Figure 2:
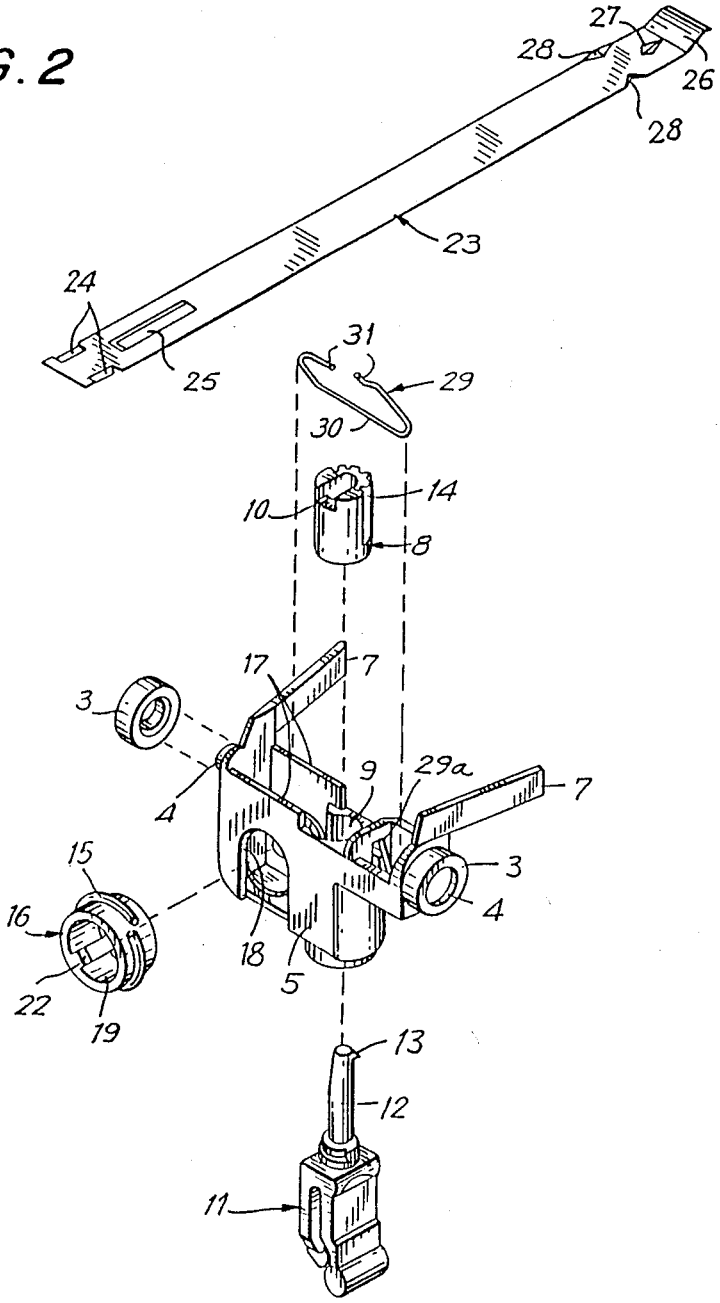
FIG. 2 is an exploded view of the traveller of the invention.

The tilting mechanism for the louvres (not shown) is contained within traveller housing 5 (FIG. 2). A worm wheel 8 is mounted in a known manner in a vertical cylindrical opening 9 in the traveller housing. The worm wheel 8 has an axial passage therethrough and a notch 10 in its side at one end. A slat hook 11 for holding a slat is provided with a shank 12 for insertion into the passageway, of the worm wheel 8. A barb 13 engages in the notch 10 to hold slat hook 11 in position relative to the worm wheel 8. Worm wheel 8 is provided with vertical teeth 14 which engage thread 15 of traveller worm 16. Traveller worm 16 is positioned between walls 17 of traveller housing 5. Walls 17 define an opening 18 which is concentric with a central passage 19 of traveller worm 16. Tilt rod 20 (FIG. 1) is inserted through opening 18 and central passage 19 when traveller worm 16 is in position. The tilt rod has three slots 21 which mate with three ribs 22 extending radially inward of central passage 19 in a known manner. In this way rotation of tilt rod 20 also rotates traveller worm 16. Thread 15 engages teeth 14 of worm wheel 8 and as traveller worm 16 is rotated causes worm wheel 8 to rotate and thereby hook 11. This rotates the louvres of the blind.

Figure 5:
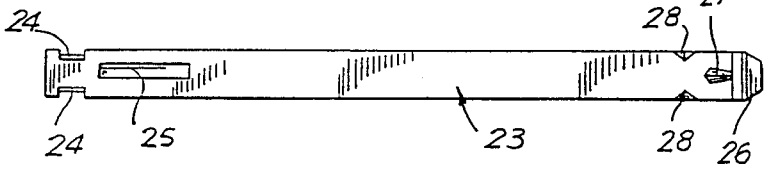
FIG. 5 is a top view of the spacer of the invention.
Figure 6:
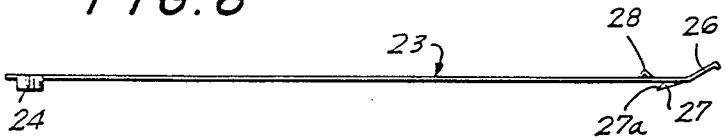
FIG. 6 is a side view of the spacer of FIG. 5.
Figure 3:
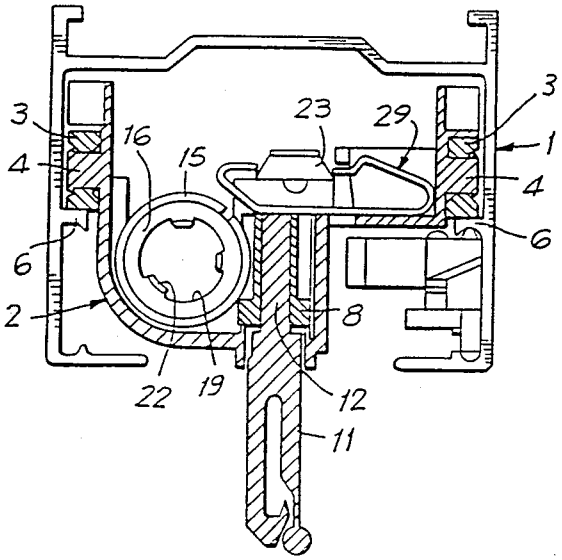
FIG. 3 is a cross-sectional view of the traveller of the invention within a headrail.

A traveller spacer 23 (FIGS. 5 and 6) provides predetermined spacing between adjacent travellers when the travellers are extended. The spacer 23 is an elongated thin piece of stainless steel. Tabs 24 are provided on either side of the spacer near one end. Tabs 24 fit in frictional engagement between walls 17 of traveller housing 5. An axial slot 25 is formed midway between the side edges of the spacer 23 near the tabs 24. At the opposite end of the spacer 23 is an inclined portion 26 which provides a guide to the end of the spacer as well as providing a back-up hooking force between spacers. A hook 27 extends downwards from the spacer surface. The hook 27 forms a hook edge 27a which extends slightly back away from the nearest spacer end. A pair of crimps 28 form bumps which extend upward from the spacer 23. The spacer 23 from a first traveller 2 extends forward from the traveller and overlies the spacer of an adjacent traveller. Each spacer overlies the spacer of the traveller in front of it and is in turn over laid by the spacer of the traveller behind it.

Figure 4:
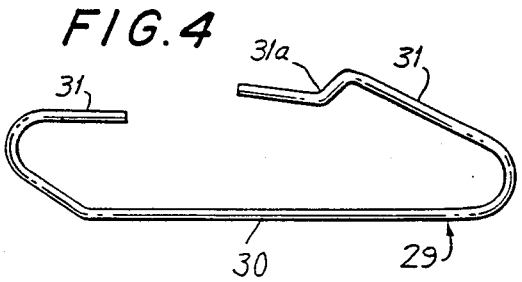
FIG. 4 is an enlarged side view of the retainer clip of the invention.

A wire retainer 29 (FIG. 4) is positioned on each traveller. The retainer 29 has a bottom leg 30 and two top end portions 31. Sandwiched between end portions 31 and the bottom leg 30 is the spacer of the next traveller (that is further from the lead traveller). The retainer wire is formed so the cantilevered end portions 31 may move resiliently. To hold the retainer in position one end is inserted into an opening 29a formed in the traveller housing and which is slightly smaller than the separation between the bottom leg 30 and end portion 31 of that end. In this manner bottom leg 30 and end portion 31 frictionally engage the walls of the opening. A lip 31a is formed to engage the wall of the opening for positive locking. Once in position retainer 29 extends above worm wheel 8 to prevent axial upward movement of the worm wheel.

The spacer of the next traveller slides relative the first traveller. As the first traveller moves away from the next traveller, hook 27 of the spacer of the next traveller slides along the upper surface of the spacer of the first traveller. As the traveller near their predetermined separation, hook 27 of the spacer of the next traveller engages slot 25 of the spacer of the first traveller. At this point end portions 31 of retainer 29 engage the crimps 28 of the spacer of the next traveller. This biases the spacer downward to hold hook 27 within slot 25 as it engages the edge of the slot 25 closest to the tabs 24. This connects the two travellers and they move in unison separated by the distance determined by the position of the hook 27 and slot 25 of the spacers. When the travellers are retracted the hooks 27 of each spacer disengage the slots and permit the spacers to slide relative each other. The spacers merely stack up as the travellers become nested on retraction. The thin spacers permit the angle of the stacked spacers to be small thus reducing the size of the headrail.

Figure 7:
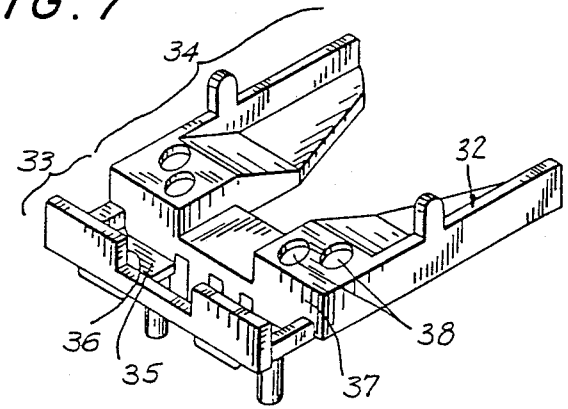
FIG. 7 is a top perspective view of the bridle of the invention.
Figure 8:
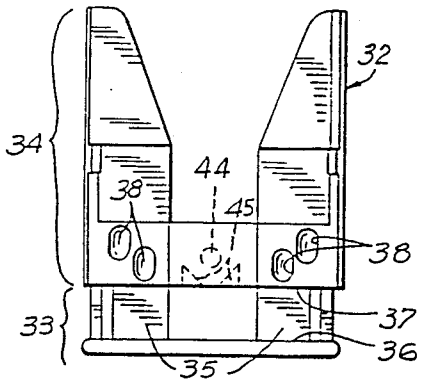
FIG. 8 is a top view of the bridle of FIG. 7.
Figure 10:
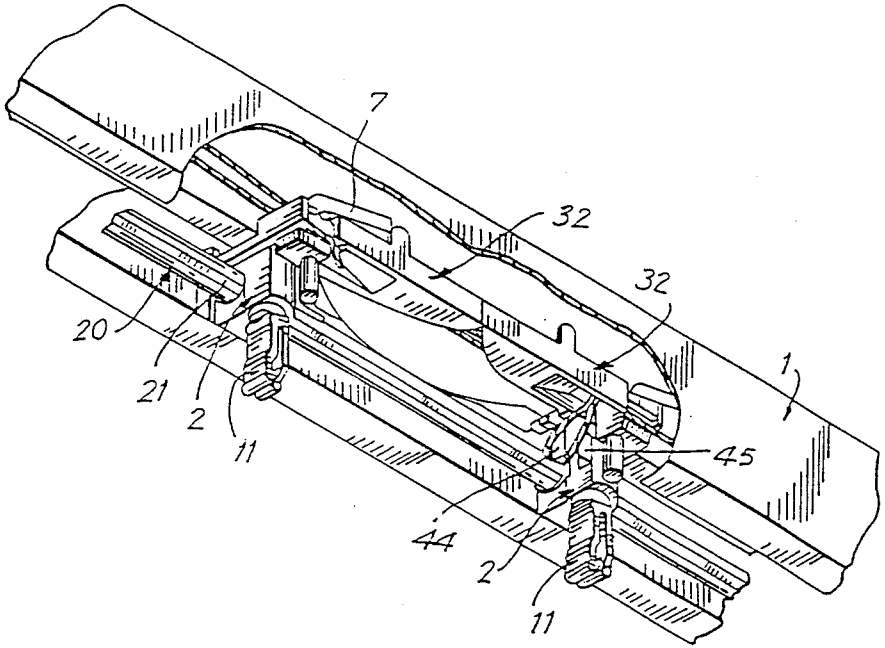
FIG. 10 is a bottom perspective cutaway view of a headrail showing the bridle of FIG. 7.

Referring now to FIGS. 7, 8 and 10 there is shown a bridle 32 for the lead traveller. As mentioned previously the pull cord for the headrail must be attached to the lead traveller. For a left or right pull blind, that is one where all the travellers move in the same direction when opening and in the opposite direction on closing, there is a single lead traveller which is attached to the cord ends. However, in a blind where half the travellers move to one side on opening and the other half move to the other side on opening there are two lead travellers. The bridle 32 of FIGS. 7 and 8 may be used in either situation.

Figure 9:
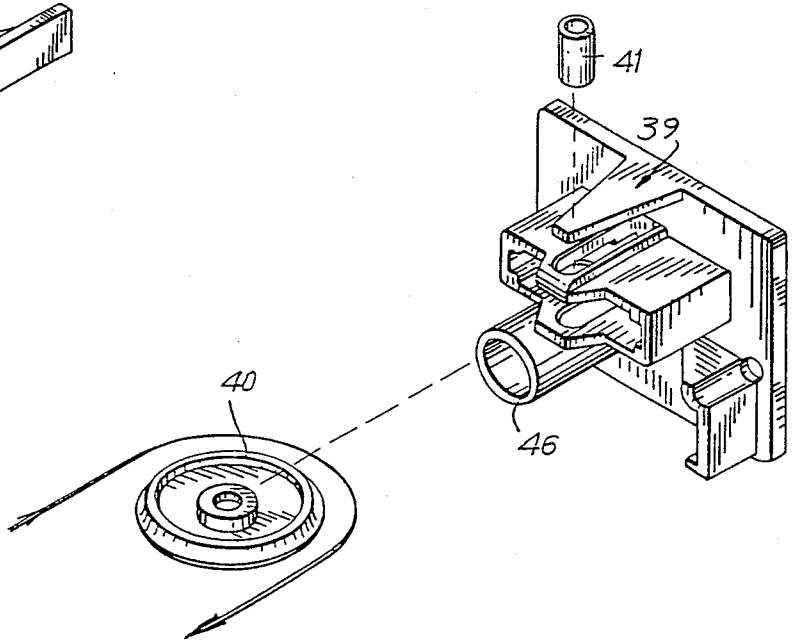
FIG. 9 is an exploded view of a first end cap for the headrail of the invention.

Bridle 32 has a holding portion 33 and a spacing portion 34. The bridle 32 slides within the headrail 1 and holds the lead traveller in holding portion 33. The traveller rests on support surfaces 35 and is positioned between walls 36 and 37. The pull cord has its ends attached to bridle 32. A first cord end is passed through one of the openings 38 and knotted so the cord end cannot be pulled back through the opening. The cord is then passed through the headrail to end cap 39 (FIG. 9). The cord passes around wheel 40 which is mounted to rotate about shaft 41. The cord then extends the length of the headrail and passes through a second end cap 42 (FIG. 11) along turning surface 43. The cord passes through a cord weight and back through the second end cap along a second turning surface 43. The cord extends back to the bridle, is passed through a second opening 38 and knotted. By pulling on the cord in one direction the lead traveller is moved in a first direction. By pulling the cord in a second direction, the lead traveller is moved in the opposite direction. When the travellers are extended, the lead traveller is pulled through the headrail until spacer portion 34 meets the end cap to stop the traveller and provide predetermining spacing of the traveller from the end cap.

In a center pull blind (FIG. 10) there are two bridles 32. Each of the two lead travellers (the first on one side of center and the second on the opposite side of center of the headrail) is mounted in its bridle so the spacer portions 34 face one another. When the blind is closed the two spacer portions will meet each other and provide proper spacing between the two lead travellers. The first lead traveller is attached to the pull cord as described above. However, the second lead traveller must be attached to the pull cord along the portion which extends through the entire length of the headrail from the first end cap to the second end cap. The novel bridle of the invention permits quick attachment of the bridle and cord. A loop is formed in the cord at the point of attachment. The loop is passed downward through one of the openings 38 and over post 44 which extends downward from the bridle 32. A pair of wedges 45 extend from the bottom of the bridle with their edges directed toward post 44. The wedges 45 each form a sharp edge which positively grips the cord preventing it from slipping around post 44. Thus the bridle 32 of the second lead traveller grips the cord to maintain its position.

Figure 11:
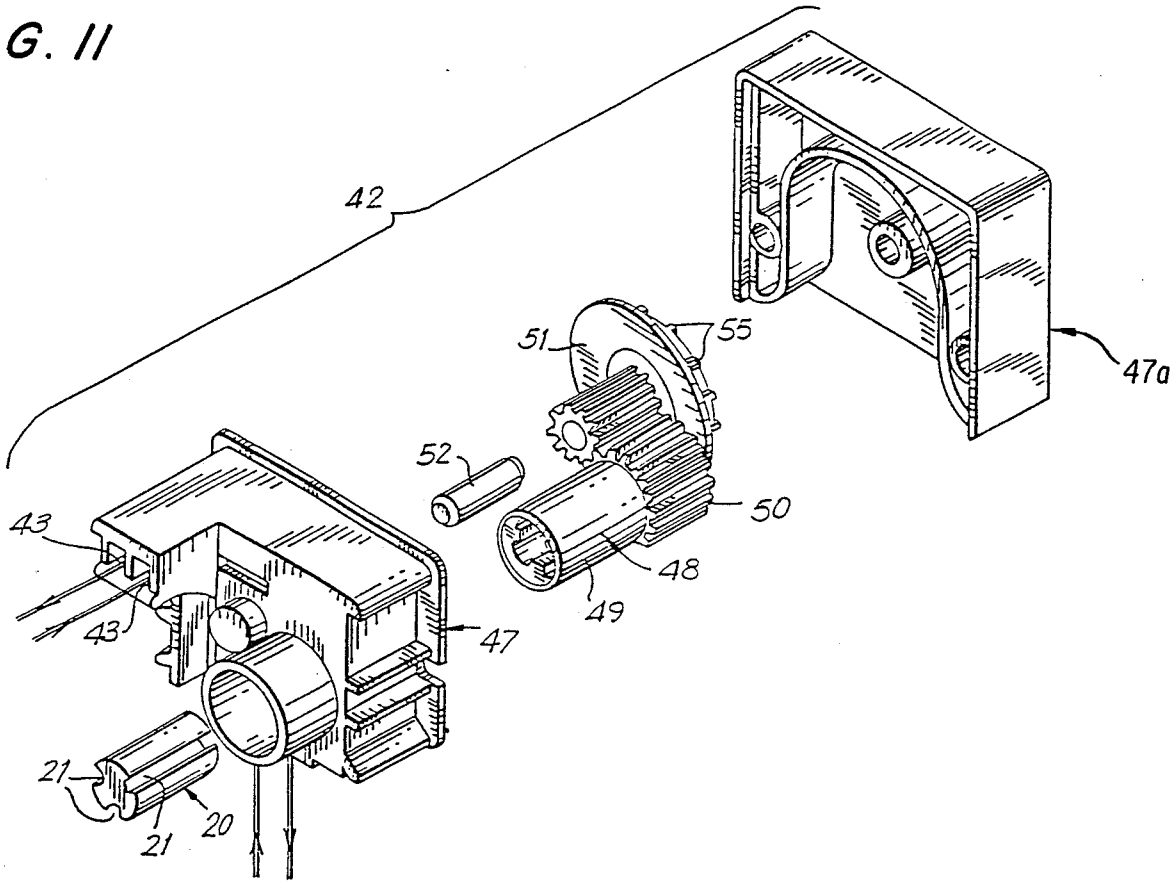
FIG. 11 is an exploded view of the second end cap of the invention showing the tilt rod rotating mechanism.

Referring to FIGS. 9 and 11 there is shown the end caps 39 and 42 of the headrail. The first end cap 39 holds wheel 40 as previously described. A sleeve 46 is formed in the end cap to act as a bearing for one end of tilt rod 20. The tilt rod 20 extends through the travellers to the second end cap 42. The second end cap 42 is comprised of a control cap 47 and a control housing 47. The control housing 47 has turning surfaces 43 for the pull cord which turn the cord at a right angle to extend out the bottom of the control housing. The tilt rod 20 extends through an opening in control housing 47 and carries a tilt gear 48 on its end. The tilt gear 48 has a sleeve 49 at one end with radially inwardly extending ribs so the tilt gear 48 can be mounted on the end of the tilt rod 20. The ribs engage slots 21 so the tilt gear 48 does not rotate relative to tilt rod 20. The end of tilt gear 48 opposite sleeve 49 is gear 50. Gear 50 engages tilt which is mounted for rotation on axle 52. Axle 52 is mounted between control cap 46 and control housing 48. One end of tilt drive 51 has circumferentially disposed teeth 55 which engage beads of a tilt chain, not shown. The tilt chain passes around the teeth 55, so pulling on tilt chain causes rotation of tilt drive 51. Rotation of tilt drive 51 causes rotation of tilt gear 48 and thereby tilt rod 20. Thus the louvres are rotated as previously described.

Figure 12:
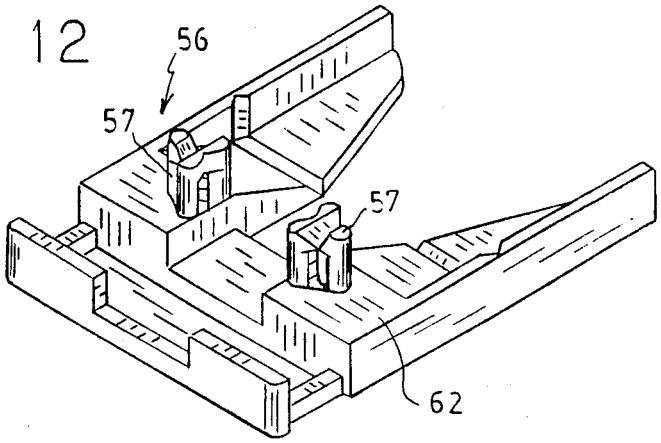
FIG. 12 is a perspective view of another embodiment of the bridle of the invention.
Figure 13:
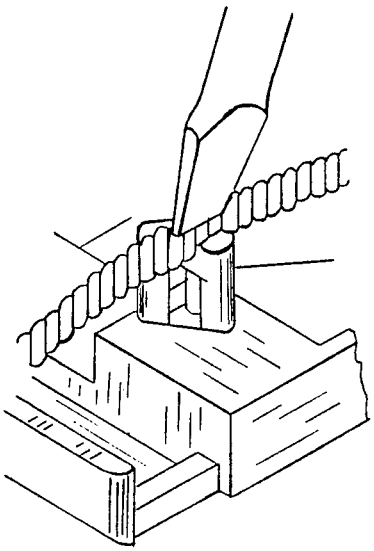
FIG. 13 is a partial perspective view of the embodiment of FIG. 12 showing the pull cord being attached.
Figure 14:
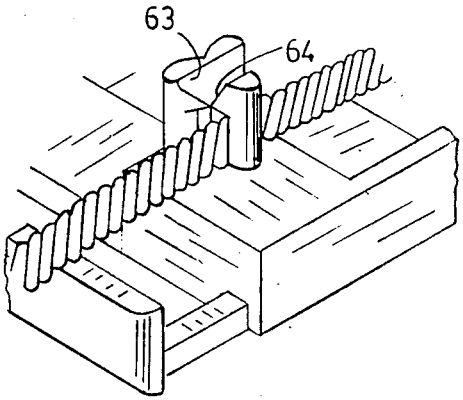
FIG. 14 is a partial perspective similar to FIG. 13 showing the pull cord in place.
Figure 15:
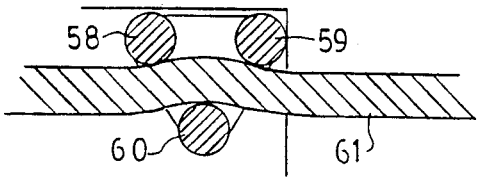
FIG. 15 is a cross-sectional view of the post connection means of the bridle shown in FIG. 12.

In the embodiment of the invention shown in FIGS. 12–15, the connection of the pull cord to the bridle is made to permit slippage under certain conditions. As shown in FIG. 12 the bridle 56 of this embodiment is basically the same construction as the bridle shown in FIG. 7. It differs therefrom in that the holes 38 of the embodiment of FIG. 7 are eliminated and the posts 44, 45 are replaced by post means 57. This post means is comprised of a first pair of posts 58, 59 which are spaced from each other and a third post 60 located between the first pair of posts and laterally offset therefrom. As shown in FIG. 15 the lateral offset of the post 60 from the posts 58, 59 is slightly less than the thickness of the pull cord 61 which is adapted to be fed therethrough. Further, the spacing between the posts 60 and each of the posts 58, 59 is about equal to the thickness of the pull cord. Finally, the posts are round in cross-section and have a diameter about equal to the thickness of the pull cord 61. With this construction, the pull cord passes between the first pair of posts 58, 59 and the third post 60 in a serpentine manner. The frictional engagement between the pull cord and the posts is sufficient to fix the pull cord to the bridle under normal loading of the pull cord along its length as the blind section with which the bridle is associated moves between opened and closed positions.

Where the two sections of the blind are of unequal width, the bridle of FIG. 12 would be used in association with a smaller section. Thus, when the smaller section has been fully extended or retracted and there is still more blind material from the larger section which must be moved to attain its fully extended or retracted position, pulling on the pull cord for this purpose will put greater tension on the pull cord where it passes through the post means 57. This is so since the bridle has reached the end of its movement in the headrail and,is prevented from further movement. This increased extension of the pull cord will cause slippage of the pull cord between the first pair of posts 58, 59 and the third post 60. This will continue until the larger section of blind has reached its extreme opened or closed position. Further movement is prevented because of the connection of the ends of the pull cord to the bridle associated with the larger blind section.

With reference to FIGS. 13 and 14, it will be seen that the post means of this embodiment of the invention are particularly suited for easy connection of the pull cord. For this purpose the pair of posts 58, 59 are connected together at the ends remote from the surface 62 of the bridle from which they extend. This connection defines a slanted surface 63 which faces the third post 60 and extends towards the surface 62 of the bridle. Similarly, the third post 60 at its end remote from the surface 62 of the bridle has a slanted surface 64. This surface faces the pair of posts 58, 59 and also extends towards the surface 62 of the bridle.

The slanted surfaces 63, 64 terminate at a location above the surface 62 so as to be spaced therefrom by distance which is greater than the thickness of the pull cord. Furthermore, the spacing of the two slanted surfaces 63 and 64 from each other is less than the thickness of the pull cord.

In order for the pull cord to be connected to the post means, it is necessary that the first pair of posts ends and the third post flex outwardly away from each other. For this purpose, the posts are made of resilient material such as plastic. Preferably they are formed integrally with the formation of the bridle itself. As shown in FIG. 13, the resiliency of the posts permits them to flex as the cord 61 is pushed downwardly against the slanted surfaces, as for example by a screw driver. The final position of the pull cord is shown in FIG. 14. As evident from this view, the pull cord is retained against escaping from the post means because of the retention under the slanted surfaces.

I claim:

1. A vertical louvre blind, comprising:

a horizontal headrail;

a pull cord, extending within said headrail;

a number of travelers;

a lead traveler; and a bridle for the lead traveller;

said travelers, said lead traveler and said bridle all sliding along said headrail, and said bridle comprising:

(a) a body having a bottom surface and means adapted to receive and retain the lead traveller;

(b) at least two openings defined by said bottom surface of said body for receiving the pull cord; and (c) a post extending downwardly from said bottom surface for being received in a loop of said pull cord which is passed through one of said at least two openings, over said post, and through a second one of said at least two openings, so that said pull cord extends down through one of said openings, around said post, and returns upwardly through one of said openings to fictionally attach said bridle and said pull cord to prevent relative movement therebetween, whereby movement of said pull cord causes the bridle to move along said headrail.

2. The blind according to claim 1 wherein said means to hold a lead traveller includes:

(a) at least one pair of spaced opposed walls for receiving said lead traveller therebetween.

3. The blind according to claim 2 further including:

(a) two spaced coplanar support surfaces for supporting said lead traveller and defining an opening therebetween for passage of a hooking portion of said lead traveller below said support surfaces.

4. The blind according to claim 3 wherein:

(a) said at lest one pair of spaced opposed walls are perpendicular to said support surface to define therewith a U-shaped cradle for receiving and supporting said lead traveller.

5. The blind according to claim 1 wherein:

(a) at least one wedge extends from the bottom of said bridle with the edge of said wedge extending vertically to engage said pull cord and thereby increase the frictional engagement between said bridle and said pull cord.

6. The blind according to claim 4 wherein:

(a) there are two wedges to provide engaging force when said pull cord passes through either of two openings.

7. A vertical louvre blind assembly, comprising:

a horizontal headrail;

two lead travellers;

a number of additional travelers;

vertical louvers attached to said travellers;

two bridles attached to said lead travellers; and a pull cord, a first of said bridles being fixedly attached to a first lead traveller and to said pull cord, and the second of said bridles being fixedly attached to the second lead traveller and frictionally attached to said pull cord, said bridles and said travellers sliding within said headrail, and said second bridle comprising:

(a) a bridle body for sliding in said headrail;

(b) means for mounting said second lead traveller to said second bridle;

(c) post means extending from a surface of said second bridle for frictional connection to said pull cord to hold the pull cord fixed to the post means up to a predetermined tension on the pull cord and to permit relative slippage of the pull cord with respect to the post means above said predetermined tension on said pull cord; and (d) said post means comprising:

(1) a pair of spaced posts positioned on one side of said pull cord at spaced locations therealong, and (2) a third post positioned on the other side of said pull cord, said third post being located between said pair of posts and laterally offset therefrom by a distance somewhat less than the thickness of the pull cord, thus causing the pull cord to take on a serpentine path in passing therebetween.

8. A assembly according to claim 7 wherein:

(a) the pair of posts are connected together at their ends from the surface of the bridle from which they extend to define a slanted surface facing said third post and extending toward the surface of the bridle; and (b) the third post, at its end remote from the surface of the bridle from which it extends, has a slanted surface facing the pair of posts and extending toward the surface of the bridle.

9. A assembly according to claim 8 wherein:

(a) said slanted surfaces terminate at a location spaced from the surface of the bridle greater than the thickness of the pull cord and at a location spaced from each other by a distance less than the thickness of the pull cord;

(b) said posts are of resilient material permitting flexing thereof away from each other upon pushing said pull cord against the slanted surfaces to thereby frictionally connect said pull cord to the post means at a location between the bridle surface and the slanted surfaces.

10. A assembly according to claim 9 wherein:

(a) the posts are round in cross-section, have a diameter about equal to the thickness of the pull cord and are spaced from each other by distances about equal to the thickness of said pull cord.

11. An off-center pull vertical louvre blind, comprising:

(a) a headrail;

(b) a number of travellers sliding along said headrail;

(c) first and second bridles, also sliding along said headrail, and being attached to first and second lead travellers respectively, said first and second lead travellers being connected to first larger and second smaller groups of said travellers, respectively, by spacer means; and (d) a pull cord being fixedly attached to the first one of said bridles and frictionally attached to the second of said bridles by post means, such that said cord is permitted to move with respect to the second bridle when the tension on the cord exceeds a predetermined amount, said post means comprising:

(i) a pair of spaced posts positioned on one side of said pull cord at spaced locations therealong; and (ii) a third post positioned on the other side of said pull cord, said third post being located between the pair of posts and laterally off-set therefrom by a distance somewhat less than the thickness of the pull cord, causing the pull cord to take a serpentine path therebetween, whereby a predetermined frictional force is exerted on said pull cord by said posts.

* * * * *

UNITED STATES PATENT AND TRADEMARK OFFICE

CERTIFICATE OF CORRECTION

PATENT NO. : 4,872,499

DATED : October 10, 1989

INVENTOR(S) : Richard N. Anderson

It is certified that error appears in the above-identified patent and that said Letters Patent is hereby corrected as shown below: On the title page:

Add the following references cited:

U.S. Patents:

| No. | Date | Name |
|---|---|---|
| 3,427,679 | 2/1969 | Znamirowski |
| 4,293,021 | 10/1981 | Arena |
| 4,381,811 | 5/1983 | Frentzel |
| 4,438,798 | 3/1984 | Ford and Haaren |
| 4,648,436 | 3/1987 | Oskam |

United Kingdom Patent:

| | | |
|---|---|---|
| 1,072,642 | 6/1967 | Eldredge, Jr. et al. |

Signed and Sealed this

Twentieth Day of November, 1990

*Attest:*

*Attesting Officer*

HARRY F. MANBECK, JR.

*Commissioner of Patents and Trademarks*